US007435523B2

(12) United States Patent
Olson et al.

(10) Patent No.: US 7,435,523 B2
(45) Date of Patent: Oct. 14, 2008

(54) CHEMICALLY PREPARED TONERS WITH SIZE LIMITING BINDERS

(75) Inventors: John Melvin Olson, Boulder, CO (US); Kasturi Rangan Srinivasan, Longmont, CO (US)

(73) Assignee: Lexmark International, Inc., Lexington, KY (US)

( * ) Notice: Subject to any disclaimer, the term of this patent is extended or adjusted under 35 U.S.C. 154(b) by 353 days.

(21) Appl. No.: 11/142,733

(22) Filed: Jun. 1, 2005

(65) Prior Publication Data

US 2006/0275689 A1 Dec. 7, 2006

(51) Int. Cl.
*G03G 9/08* (2006.01)

(52) U.S. Cl. ..... 430/137.14

(58) Field of Classification Search ..... 430/137.14
See application file for complete search history.

(56) References Cited

U.S. PATENT DOCUMENTS 4,983,488 A * 1/1991 Tan et al. ..... 430/137.14
5,114,820 A 5/1992 Georges et al.
5,256,516 A 10/1993 Winnik et al.
6,294,306 B1 * 9/2001 Kmiecik-Lawrynowicz et al. ..... 430/137.14
6,531,254 B1 3/2003 Bedells et al.
2004/0091809 A1 5/2004 Qian et al.
2004/0137348 A1 7/2004 Sun et al.
2006/0115757 A1 * 6/2006 Takahashi et al. ..... 430/109.3

FOREIGN PATENT DOCUMENTS

GB 2107893 A 5/1983

* cited by examiner

*Primary Examiner*—John L Goodrow
(74) *Attorney, Agent, or Firm*—Steven J. Grossman

(57) ABSTRACT

Chemically prepared toner is manufactured by aggregation in which the binder resin is a latex copolymer having a methacrylic acid ester of long chain, saturated alkyl, which may be lauryl methacrylate. This binder resin has a small amount by weight of acrylic acid component and has other nonionic components, which may be styrene and butyl acrylate moieties. Aggregation is carried out in an aqueous medium, which may have organic solvent components. The aggregation is then heated, and because of the selection of the binder resin to have the long chain ester, the heating step has minimal effect on particle size.

11 Claims, No Drawings

CHEMICALLY PREPARED TONERS WITH SIZE LIMITING BINDERS

TECHNICAL FIELD

This invention relates to methods for manufacture of chemically prepared toners by aggregation having desired particle size. Such toners are often termed "chemical toners."

BACKGROUND OF THE INVENTION

This invention describes a method to prepare chemically toner, wherein the particle size of the required toner is achieved by aggregation (flocculation), preferably using an acid for flocculation, which is unaffected by any temperature change. A desired particle size may be achieved during the flocculation process involving a latex, a pigment and a wax dispersion, using a required amount of acid. As the process is not sensitive to temperature, there is no further particle size growth, and also no loss in particle size during the fusing process. Toners prepared by this method exhibit good print quality.

One of the important requirements of laser printers is print quality. While there are several factors that affect print quality, one of the key factors is toner. In color laser printers, resolution is very critical. Higher or better resolution can be achieved by using small particle size toners. Small particle size toners are more difficult to achieve from a conventional toner processing technique, due to limitations in mechanical extruding/grinding. A more favorable way to achieve small particle size toner is to prepare the same through a chemical process.

There are at least two ways to prepare a chemical toner, suspension polymerization, or emulsion agglomeration (EA) processes. In an EA process, a latex is mixed or formed with a dispersion typically comprised of a pigment and wax, used either as individual dispersions or as a composite dispersion. The mixture is flocculated by addition of an inorganic salt, or an acid. The conversion of sub-micron particles of latex, pigment, and wax to micron(s) size aggregates is then increased by heating the mixture to a desired particle size.

To prevent any further growth of the toner particles, the pH is suitably adjusted to more alkaline conditions, and the particles are eventually heated at temperatures (above the softening temperature of the latex) to fuse and form a spherical or nearly spherical particle.

The spherical or non-spherical toner then can be mixed with extra particulate additives such as silica, titania, or other inorganic oxides to help in print quality or prevent the toner particles from sticking to each other.

This invention describes the use of a latex containing a long chain hydrocarbon such as a $C_{12}$ chain (dodecyl, lauryl) monomer like lauryl methacrylate, to carry out the preparation of a chemical toner. The latex along with a pigment (cyan, magenta, yellow, etc) and wax (example polyethylene) on flocculation in the presence of a required amount of acid (example: nitric acid) can result in an aggregate whose size is easily adjusted by the amount of acid added. The aggregate is insensitive to temperature changes and on heating above the softening temperatures results in a generally round, but non-spherical particle.

The advantage of a non-spherical particle is the lower tendency of it to fuse or film in the developer nip, and the improved ease in cleaning off a photoconductor or photoreceptor member. This invention provides ease in manufacturability of the toner of desired size, since the tendency to increase in particle size is not dependent on temperature. Narrow particle size distributions are more readily achieved.

Lauryl methacrylate moieties in binder resins of dry toners are shown in U.S. Pat. No. 5,256,515 to Winnik et al. and U.S. Pat. No. 5,114,820 to Georges et al., and in UK Patent application 2 107 893 A by Kao Corporation. U.S. Patent Pub. No. 2004/0091809 by Qian et al. is illustrative of similar uses in liquid toners.

Toner manufactured by aggregations is exemplified by U.S. Pat. No. 4,983,488 to Tan et al, and U.S. Pat. No. 6,531,254 B1 to Bedells, as well as U.S. Patent Pub. No. 2004/0137348 A1 by Sun et al (assigned to the assignee of this invention).

DISCLOSURE OF THE INVENTION

In accordance with this invention chemically prepared toner is manufactured by aggregation in which the binder resin is a latex copolymer having a methacrylic acid ester moiety of long chain, saturated alkyl, which may be lauryl methacrylate (the long chain length thereby being 12). The binder resin has a small, but important, amount by weight acrylic acid moiety and may have other nonionic components which are not long chain, which may be styrene and butyl acrylate moieties. Aggregation is carried out in an aqueous medium, typically having organic solvent components. The aggregation is induced by adding acid. The aggregation is then heated to smooth the particles, as is standard, but because of the selection of the binder resin to have the long chain ester, the heating step has minimal effect on particle size

DESCRIPTION OF THE PREFERRED EMBODIMENTS

In accordance with this invention it was found that in order to obtain a process that is relatively stable to pH in the preparation of a chemically prepared toner, the latex (or binder) and the type of surfactant may have a significant role. As seen in the foregoing patent U.S. Pat. No. 6,531,254 B 1, use of a polymeric alkylene glycol ether is a viable surfactant in the preparation of chemical toners.

It was found that in order to obtain a process that is relatively stable to pH in the preparation of a chemically prepared toner, the latex (or binder) and the type of surfactant may have a significant role. As seen in the foregoing U.S. Pat. No. 6,531,254 B 1, use of a polymeric alkylene glycol ether is a viable surfactant in the preparation of chemical toners.

The latex syntheses were carried out using a polymeric alkylene glycol ether, such as AKYPO RLM 100 (Kao Specialities). It was found that the surfactant concentration was adequate at 0.5% to about 2.5%. It may be borne in mind that higher concentrations of surfactant result in addition of several washing steps following the toner preparation which in turn increases the manufacturing cost of the said toner. Hence it is recommended that the lowest surfactant concentration be used to obtain a stable latex. Several latex preparations were carried out. The general procedure adopted in the latex synthesis is outlined below:

COMPARATIVE EXAMPLE 1

Latex Preparation

A latex comprising styrene (142 g), butyl acrylate (26.2 g), methacrylic acid (0.69 g), 2-hydroxyethyl methacrylate (4.3 g), and 1 dodecanethiol (4.3 g) was prepared as follows: AKYPO RLM100 (5.2 g) and 250 g of de-ionized water was placed in a 1 L reactor flask and stirred with a mechanical stirrer under a nitrogen atmosphere. The solution was then heated and stirred at 75 C. All monomers and the chain-transfer agent were thoroughly mixed. About 1.7 g of the monomer mixture was transferred to the reactor and stirred at 75 C for about 10 minutes. Ammonium persulfate (0.86 g) was then dissolved in 10 g of DI water and added over 15 minutes. The reaction mixture was stirred for 15 minutes, at 75 C. The remaining monomer mixture was added over a 3 h period. Following the completion of monomer addition, the reaction mixture was stirred for 4 h at 75 C, and then cooled. On filtration, about 443 g of the latex was obtained with the characteristics: molecular weight: Mn 4.3K, Mw 23.2K, polydispersity 5.44.

In a similar manner monomers were suitably modified to derive several latexes. The following Table 1 lists the monomers, their weight and the corresponding latex.

TABLE 1

| Ingredients | Comp. Example 1 | Comp. Example 2 | Comp. Example 3 | Example 1 |
|---|---|---|---|---|
| Styrene | 142 g | 130 g | 130 g | 171.5 g |
| Butyl acrylate | 26.2 g | 37.5 g | 37.5 g | 25.2 g |
| Methacrylic acid | 0.69 g | 1.70 g | 0 g | 1.83 g |
| 2-Hydroxyethyl methacrylate | 4.3 g | 0.80 g | 0.80 g | 1.00 g |
| Lauryl methacrylate | 0 g | 0 g | 0 g | 10.50 g |
| 1-Dodecanethiol | 4.3 g | 3.2 g | 3.2 g | 3.30 g |
| Ammonium persulfate | 0.86 g | 1.50 g | 1.50 g | 1.50 g |
| De-ionized water | 260 g | 260 g | 260 g | 250 g |
| AKYPO RLM 100 | 5.2 g | 0.90 g | 0.90 g | 5.20 g |
| Mn/Mw/polydispersity | 4.2K/23.2K/5.44 | 6.5K/32.2K/4.93 | 7.5K/43.9K/5.82 | 12.1K/37.9K/3.11 |
| Stability of Latex | Stable | Stable | Stable | Stable |

As seen in Table 1, several latexes were prepared by a procedure described in Comparative Example 1 below. All of the foregoing materials were used in the preparation of chemically prepared toners.

Pigment and Wax Dispersions:

An aqueous dispersion comprising a wax (Polyethylene, PW500, Petrolite Corp.), a pigment (Sun Chemical Pigment Blue 15:3BG, Pigment Red PR122, or Clariant Pigment Yellow PY180HG) and a polymeric dispersant comprising of methacrylic acid/nonylphenylpolypropylene glycol/tristyrenated phenol polyethyleneglycol terpolymer (molar ratio: 12.06/3.38/1) in water were prepared by stirring the mixture in a high shear mixer, followed by a MICROFLUIDIZER. The particle size of the resulting dispersions were about 80-200 nm (by volume). The pigment wax dispersions were used as is, without any further modifications.

In all pigment/wax dispersions, the by weight ratio of pigment/wax/dispersant was 43.41/18.60/37.98.

Charge Control Agent

The examples detailed were for developmental purposes and did not always contain a charge control agent. In some cases an organoboron charge control agent (trade name LR-147) was used at about 6% by weight in the wax/pigment/dispersant/charge control agent mixture.

Extra Particulate Additives

All toners were treated with extra particulate additives such as silicas, titanias, or mixtures thereof in a Waring blender, prior to evaluation in a printer. The extra particulate additives were used at about 0.5% to about 3% by weight of the weight of the toner.

COMPARATIVE EXAMPLE 1

Emulsion Aggregation 268 g of latex and DI water (332 g) were placed in a 2 L reactor. The mixture was stirred for 10 min at 23 C. A pigment/wax dispersion (POLYWAX 500/Pigment Red 122, 143 g), and 2-propanol (140 g) was then added and stirred for 10 minutes. The resulting mixture had a particle size of about 300 nm (d50, volume) and 243 nm (d50, number). About 150 g of 1% nitric acid was added over a 10 minute period, to adjust the pH of the mixture from 6.5 to about 3.59. The aggregated species had a particle size of about 7.59μ (volume). The solution was heated slowly from 23 C to about 84 C. On heating the solution at 88 C, there was a growth in particles <2 microns. Following a 2 h stir at 84 C, the reaction was cooled and filtered. The filtrate appeared white, and the solid residue had a white layer on top. The solid toner was washed at least 4 times in DI water and filtered. The toner was dried at 43 C/48 h.

COMPARATIVE EXAMPLE 2

Latex: A latex comprising of styrene (130 g), butyl acrylate (37.5 g), methacrylic acid (1.70 g), 2-hydroxyethyl methacrylate (0.80 g), and 1-dodecanethiol (3.2 g) was prepared in a manner similar to Comparative Example 1. The surfactant used was AKYPO RLM100 (0.90 g), and ammonium persulfate (1.50 g) was use as an initiator. The resulting characteristics were: molecular weight: Mn: 6.5K, Mw: 32.2K, polydispersity: 4.9, Tg: 51 C.

Emulsion Aggregation: 268 g of latex and DI water (332 g) were placed in a 2 L reactor. The mixture was stirred for 10 minutes at 23 C. A pigment/wax dispersion (POLYWAX 500/Pigment Red 122, 143 g), and 2-propanol (140 g) were added to the reactor and stirred for 10 minutes. The resulting mixture had a particle size of about 428 nm (d50, volume), and 336 nm (d50, number). About 150 g of 1% nitric acid was added over a 10 minute period, to adjust the pH of the mixture from 7.38 to about 3.65. The aggregated species had a particle size of about 14.77μ (volume). The solution was heated slowly from 23 C to about 84 C. On heating the solution at 84 C, there was a significant growth in particles, and d50 increased to about 36 microns. The reaction was terminated following a 1 h reflux at 84 C. The solid toner was washed at least 4 times in DI water and filtered. The toner was dried at 43 C/48 h.

COMPARATIVE EXAMPLE 3

Emulsion Aggregation: 230 g of the latex of Comparative Example 2 and DI water (300 g) were placed in a 2 L reactor.

The mixture was stirred for 10 min at 23 C. 110 g of pigment/wax dispersion (POLYWAX 500/Pigment Red 122), and 2-propanol (120 g) were added to the reactor and stirred for 10 minutes. The resulting mixture had a particle size of about 342 nm (d50, volume), and 280 nm (d50, number). About 180 g of 1% nitric acid was added over a 45 minute period, to adjust the pH of the mixture from 7.21 to about 2.03. The aggregated species had a particle size of about 5.02μ (volume). The solution was heated slowly from 23 C to 58 C, at which time there was an increase in particle size, from about 5.87μ to about 7.31μ. At this stage the pH was increased from about 1.33 to about 3.63 by the addition of 10% aqueous sodium hydroxide solution. The pH was not adjusted any further. The reaction was terminated following a 3 h reflux, and the toner particle size was about 6.74μ. A significant portion of small particles (<2μ) was observed. The solid toner was washed at least 4 times in DI water and filtered. The toner was dried at 43 C/48 h.

As can be seen from Comparative Examples 1 and 2, upon mixing the latex with a dispersion comprised of a pigment and a wax, a homogeneous mixture is obtained. The mixture is then flocculated using acid, namely 1% nitric acid, resulting in a particle size change from about 300 nm to about 6-15 microns. No change in particle size is observed until about a refluxing temperature of about 82 C or greater. Whereas in Comparative Example 1 process, there seems to be an increase in small particles (also called fines). In Comparative Example 2 there is a significant growth in the flocculate itself (i.e., a change in size from about 14 microns to about 36 microns). In Comparative Example 2, one method of restricting any further particle size growth is by adjusting the pH, i.e. by increasing pH from acidic to neutral or basic (pH >7). Hence, neither of these latexes result in a stable system. Comparative Example 3 has a latex nearly identical to the foregoing patent U.S. Pat. No. 6,531,254 B 1, but the latex/pigment particles had a tendency to grow in size and required a pH adjustment similar to those typically discussed in prior-art.

EXAMPLE 1

Latex: A latex comprising of styrene (171.5 g), butyl acrylate (25.2 g), methacrylic acid (1.83 g), 2-hydroxyethyl methacrylate (1.00 g), lauryl methacrylate (10.50 g) and 1-dodecanethiol (3.3 g) was prepared as follows: AKYPO RLM100 (5.2 g) with 225 g of de-ionized water were placed in a 1 L reactor flask and stirred with a mechanical stirrer under a nitrogen atmosphere. The solution was then heated and stirred at 75 C. All monomers and chain-transfer agent were thoroughly mixed. About 2.1 g of the monomer mixture was transferred to the reactor and stirred at 75 C for about 10 minutes. Ammonium persulfate (1.50 g) was then dissolved in 10 g of DI water and added over 15 minutes. The reaction mixture was stirred for 15 minutes at 75 C. The remaining monomer mixture was added over a 3 h period. Following the completion of monomer addition, the reaction mixture was stirred for 4 h at 75 C and then cooled. Upon filtration, about 496 g (95%) of the latex was obtained. which had the following characteristics: particle volume (d50): 346 nm; particle number (d50): 317 nm, molecular weight: Mn: 12.1K, Mw: 37.9 K, polydispersity: 3.11

Emulsion Aggregation: 268 g of the immediately preceding latex and DI water (332 g) were placed in a 2 L reactor. The mixture was stirred for 10 min at 23 C. To the mixture was added a pigment/wax dispersion (POLYWAX 500/Pigment Red 122; 143 g), and 2-propanol (140 g) and then stirred for 10 minutes. The resulting mixture had a particle size of about 326 nm (d50, volume). About 127 g of 1% nitric acid was added over a 10 minute period to adjust the pH of the mixture from 7.36 to about 3.96. The aggregated species had a particle size of about 7.46μ (volume). The solution was heated slowly from 23 C to about 85 C and no change in particle size was observed. The solution was refluxed at 85 C for 2 h, then cooled and filtered. The solid toner was washed at least 4 times in DI water and filtered. The toner was dried at 43 C/48 h.

The emulsion aggregation using Example 1 latex (latex containing 5% lauryl methacrylate) exhibits a different behavior. Following the flocculation the particle size appears to be stable, and no change is observed during the refluxing step. This is in contrast to Comparative Examples 1 and 2, where the aggregates were not stable at the coalescence or fusing step (during reflux). This procedure is advantageous from a manufacturing standpoint since the required particle size is obtained during the acid addition, and temperature does not have an effect on any further particle size growth. Also it appears that the presence of the lauryl methacrylate group appears to stabilize the aggregates, thereby mitigating or preventing any change in particle size. It may also be noted that the final toner particles were not spherical shape, but rather an "oblong potato-shape".

EXAMPLE 2

Emulsion Aggregation: 268 g of latex (similar to Latex in Example 1) and DI water (432 g) were placed in a 2 L reactor flask. The mixture was stirred for 10 min at 23 C. A pigment/wax dispersion (POLYWAX 500/Pigment Blue 153; 147 g), and 2-propanol (140 g) were then added to the reactor and then stirred for 10 minutes. The resulting mixture had a particle size of about 342 nm (d50, volume). About 127 g of 1% nitric acid was added over a 10 minute period to adjust the pH of the mixture from 7.27 to about 3.96. The aggregated species had a particle size of about 8.98μ (volume). The solution was heated slowly from 23 C to about 85 C and no change in particle size was observed. The solution was refluxed at 85 C for 2 h, (particle size distribution d50, volume was 8.23μ), then cooled and filtered. The solid toner was washed at least 4 times in DI water and filtered. The toner was dried at 43 C/48 h.

In Example 2, latex similar to Example 1 was used, the only difference was the pigment, namely Pigment Blue 15:3 was used instead of pigment Red 122. The results were similar to Example 1.

EXAMPLE 3

An emulsion aggregation was carried out in a manner similar to Example 2, with the following exceptions: evaluations were made of the effect of 2-propanol concentration, and of the change in pH prior to fusing the toner particle aggregates.

Emulsion Aggregation: 274 g of latex (similar to latex in Example 1) and DI water (530 g) were placed in a 2 L reactor. The mixture was stirred for 10 min at 23 C. A pigment/wax dispersion (POLYWAX 500/Pigment Blue 153; 158 g), and 2-propanol (60 g) was added to the reactor and then stirred for 10 minutes. The resulting mixture had a particle size of about 359 nm (d50, volume). About 135 g of 1% nitric acid was added over a 30 minute period, to adjust the pH of the mixture from 7.15 to about 4.00. The aggregated species had a bimodal particle size distribution of 3.76μ and 493 nm (volume). An additional 100 g of 2-propanol was added and pH adjusted to 3.80, the resulting aggregate showed a monomodal peak with a PS of about 6.66μ. The solution was heated slowly from 23 C to about 80 C, no change in particle size was observed. At 80 C, the pH was changed from 3.57 to 7.50, by addition of about 4.5 g of 10% aqueous sodium hydroxide (NaOH). No change in particle size was observed. The solution was refluxed at 84 C for 2 h (PSD (d50, volume) was 6.16μ) then cooled and filtered. The solid toner was washed at least 4 times in DI water and filtered. The toner was dried at 43 C/48 h.

In Example 3, the concentration effect of 2-propanol was evaluated. The amount of 2-propanol was lowered from about 140 g to about 60 g. On flocculation, a bimodal peak was observed corresponding to 3.76μ and 493 nm. However, on addition of about 100 g of 2-propanol, only a monomodal peak, with a d50 of about 6.66μ was observed thereby indicating the concentration effect of 2-propanol on this system. Also the pH of the aggregate solution was modified, by increasing the pH from about 3.5 to about 7.50 with the addition of 10% sodium hydroxide solution. No change in particle size was observed. The resulting toner, on drying, had a circularity or sphericity similar to that of Examples 1, 2 or 3.

Blends of non-lauryl methacrylate and lauryl methacrylate

In order to further the study the effect of lauryl methacrylate, a blend of two latex containing 0% and 5% lauryl methacrylate was used in the emulsion aggregation step. The preparation of the non-lauryl methacrylate latex is described immediately below:

EXAMPLE 4

Latex: A latex comprising of styrene (263.0 g), butyl acrylate (75.0 g), methacrylic acid (3.00 g), 2-hydroxyethyl methacrylate (1.6 g), and 1-dodecanethiol (5.40 g) was prepared as follows: AKYPO RLM100 (0.7 g) with 450 g of de-ionized water were placed in a 1 L reactor flask and stirred with a mechanical stirrer under a nitrogen atmosphere. The solution was then heated and stirred at 75 C. All monomers and the chain-transfer agent were thoroughly mixed. About 4.0 g of the monomer mixture was transferred to the reactor and stirred at 75 C for about 10 minutes. Ammonium persulfate (2.30 g) was then dissolved in 20 g of DI water and added over 20 minutes, and stirred for about 20 minutes. The remaining monomer mixture was added over a 3.5 h period. Following the completion of monomer addition, the reaction mixture was stirred for 4 h at 75 C, and cooled. On filtration, about 768 g (93%) of the latex was obtained of characteristics: PSD (particle size distribution): volume (d50): 346 nm; number (d50): 317 nm. molecular weight: Mn: 9.7K, Mw: 33.4 K, polydispersity: 3.91.

Emulsion Aggregation: 188 g of latex (non-lauryl methacrylate) from Example 4 and 98 g of latex from Example 1 (5% lauryl methacrylate) and DI water (430 g) were placed in a 2 L reactor flask. The mixture was stirred for 10 minutes at 23 C. A pigment/wax dispersion (POLYWAX 500/Pigment Blue 15:3; 147 g), and 2-propanol (110 g) was added to the reactor and then stirred for 10 minutes. The resulting mixture had a particle size of about 326 nm (d50, volume). About 137 g of 1% nitric acid was added over a 30 minute period, to adjust the pH of the mixture from 7.38 to about 3.57. The aggregated species had a particle size of about 10.1 microns (volume). The solution was then heated slowly from 23 C to about 83 C. At 80 C, pH was changed from 2.70 to 7.80 by addition of 10% NaOH and no change in particle size was observed. The solution was refluxed at 86 C for 4 h (particle size was about 9.06, then the solution was cooled and filtered. The solid toner was washed at least 4 times in DI water and filtered. The toner was dried at 43 C/48 h.

As described previously, the use of two different latex, of which only one latex contains lauryl methacrylate, exhibit the same behavior as a lauryl methacrylate latex, in an emulsion aggregation process. To further confirm this behavior, the non-lauryl methacrylate latex was prepared in the absence of AKYPO RLM100. The emulsion aggregation process was similar to those outlined earlier. Not surprisingly, the results were similar to those observed in Examples 1-3.

EXAMPLE 5

Latex: A latex comprising of styrene (263.0 g), butyl acrylate (75.0 g), methacrylic acid (3.00 g), 2-hydroxyethyl methacrylate (1.6 g), and 1-dodecanethiol (5.40 g) was prepared as follows: Styrene sulfonic acid sodium salt (0.7 g) with 450 g of de-ionized water were placed in a 1 L reactor flask and stirred with a mechanical stirrer under a nitrogen atmosphere. The solution was then heated and stirred at 75 C. All monomers and chain-transfer agent were thoroughly mixed. Ammonium persulfate (2.30 g) was then dissolved in 20 g of DI water and added over 20 minutes, and then stirred for about 20 mins. The monomer mixture was added over a 3.5 h period. Following the completion of monomer addition, the reaction mixture was stirred for 4 h at 75 C, and cooled. On filtration, about 768 g (93%) of the latex was obtained having the following characteristics: PSD: volume (d50): 346 nm; number (d50): 317 nm, molecular weight: Mn: 19.7K, Mw: 44.3 K, polydispersity: 2.23.

Emulsion Aggregation: 137 g of latex (non-Lauryl methacrylate) from Example 5 and 137 g of latex from Example 1 (5% lauryl methacrylate) and DI water (430 g) were placed in a 2 L reactor flask and stirred for 10 minutes at 23 C. A pigment/wax dispersion (POLYWAX 500/Pigment Blue 15:3; 147 g), and 2-propanol (120 g) was added to the reactor flask and then stirred for 10 minutes. The resulting mixture had a particle size of about 323 nm (d50, volume). About 135 g of 1% nitric acid was added over a 30 minute period, to adjust the pH of the mixture from 7.44 to about 3.44. The aggregated species had a particle size of 9.37μ (volume). The solution was heated slowly from 23 C to about 83 C. At 83 C, pH was changed from 2.99 to 8.03 by addition of 6 g of 10% NaOH and no change in particle size was observed. The solution was refluxed at 84 C for 1.5 h, particle size was about 8.93 microns, solution was then cooled and filtered. The solid toner was washed at least 4 times in DI water and filtered. The toner was dried at 43 C/48 h.

One mode of identifying toners with better properties is to evaluate the amount of small particles (or fines) (where small particles are <2μ in size). The percent small particles was determined using a Sysmex FPIA 2100 Particle size instrument, and measured using the number average particle size. The following Table 2 is a comparison of the small particles in three toners:

TABLE 2

| | % Small Particles |
|---|---|
| Comparative Example 1 | 50% |
| Comparative Example 3 | 71% |
| Example 1 | 1.7% |

The toners prepared were evaluated to about 500 pages in a Lexmark C752 printer. Results are shown in Table 3 below:

TABLE 3

| | Developer Roll Film | Doctor Blade Filming |
|---|---|---|
| Comparative Example 1 | Yes | Yes |
| Comparative Example 2 | Yes | Yes |
| Example 1 | No | No |
| Example 2 | No | No |
| Example 3 | No | No |
| Example 4 | No | No |
| Example 5 | No | No |

Toners containing the lauryl methacrylate in the polymer backbone did not exhibit any filming on either the developer roll or doctor blade, whereas Comparative Examples 1 and 2 both exhibited filming on the developer roll and doctor blade.

It is hence apparent that the incorporation of lauryl methacrylate in a polymer backbone results in a latex, which in combination with a surfactant such as a polymeric aklylene glycol ether, results in a very stable emulsion aggregation process. The resulting toner exhibits good print quality with no filming of a developer roll or doctor blade. This is in contrast to a non-lauryl methacrylate system, which is highly pH and temperature sensitive, and may result in filming of a developer roll or doctor blade. The corresponding use of other esters with a long chain, saturated alkyl moiety is clearly apparent from the foregoing.

What is claimed is:

1. A process for manufacturing chemically prepared toner by aggregation in an aqueous medium comprising:

combining lauryl methacrylate, acrylic acid moiety, a non-ionic monomer and a colorant materials and forming a latex in aqueous medium;

aggregating upon addition of acid and forming toner particles having a particle size;

heating said aggregated latex, wherein said heating does not have any further effect on particle size growth.

2. The process of claim 1 wherein said aqueous medium contains an organic solvent.

3. The process of claim 2 wherein said organic solvent is propanol.

4. The process of claim 1 wherein said latex comprises at least 5 percent by weight lauryl methacrylate based on the weight of the latex.

5. The process of claim 1 wherein said latex comprises about 1.0 percent by weight acrylic acid moiety, based upon the weight of said latex.

6. The process of claim 1 wherein said non-ionic monomer comprises styrene or butyl acrylate.

7. The process of claim 1 wherein said acrylic acid moiety comprises methacrylic acid.

8. The process of claim 1 wherein said toner particles formed upon aggregation have a volume particle size of 7.46 microns.

9. The process of claim 1 wherein said toner particles formed upon aggregation have a volume particle size of 9.37 microns.

10. The process of claim 1 wherein said acid for aggregation comprises nitric acid.

11. A process for manufacturing chemically prepared toner by aggregation in an aqueous medium comprising:

combining lauryl methacrylate, acrylic acid moiety, a non-ionic monomer and a colorant materials and forming a latex in aqueous medium containing organic solvent, wherein said lauryl methacrylate is present at a level of at least 5 percent by weight of said latex;

aggregating upon addition of acid and forming toner particles having a particle size;

heating said aggregated latex, wherein said heating does not have any further effect on particle size growth.

* * * * *